US011781559B2

(12) United States Patent
Gramlich et al.

(10) Patent No.: US 11,781,559 B2
(45) Date of Patent: Oct. 10, 2023

(54) SIDE CHANNEL COMPRESSOR FOR COMPRESSING GAS

(71) Applicant: MAHLE International GmbH, Stuttgart (DE)

(72) Inventors: Christian Gramlich, Stuttgart (DE); Daniel Schatz, Stuttgart (DE); Johannes Weinmann, Stuttgart (DE)

(73) Assignee: Mahle International GmbH, Stuttgart (DE)

( * ) Notice: Subject to any disclaimer, the term of this patent is extended or adjusted under 35 U.S.C. 154(b) by 0 days.

(21) Appl. No.: 17/246,553

(22) Filed: Apr. 30, 2021

(65) Prior Publication Data

US 2021/0340994 A1 Nov. 4, 2021

(30) Foreign Application Priority Data

Apr. 30, 2020 (DE) ..... 10 2020 205 531.9

(51) Int. Cl.
*F04D 29/42* (2006.01)
*F04D 29/08* (2006.01)
(Continued)

(52) U.S. Cl.
CPC ..... *F04D 29/4213* (2013.01); *F04D 5/002* (2013.01); *F04D 5/007* (2013.01);
(Continued)

(58) Field of Classification Search
CPC ..... F04D 5/007; F04D 23/008; F04D 29/083; F04D 29/403; F04D 29/422; F04D 17/168
See application file for complete search history.

(56) References Cited

U.S. PATENT DOCUMENTS 5,224,836 A 7/1993 Gunn et al.
5,785,490 A * 7/1998 Dobler ..... F04D 5/002 415/55.1
(Continued)

FOREIGN PATENT DOCUMENTS

CN 103047190 A 4/2013
CN 103953560 A 7/2014
(Continued)

OTHER PUBLICATIONS

U.S. Appl. No. 17/246,560, filed Apr. 30, 2021, Daniel Schatz.
(Continued)

*Primary Examiner* — Eldon T Brockman
*Assistant Examiner* — Andrew J Marien
(74) *Attorney, Agent, or Firm* — Ewers IP Law PLLC; Falk Ewers

(57) ABSTRACT

A side channel compressor for compressing gas includes a housing, which forms a side channel, and an impeller drive arranged in the housing. The housing forms a feed channel fluidically connected to the side channel for feeding gas to the side channel and a discharge channel for discharging gas out of the side channel that is fluidically connected to the side channel. The feed channel branches into two separate channel arms each extending along a channel arm center axis. The housing is subdivided along a separating plane into first and second housing parts which sealingly lie against one another. The discharge channel is passed through between the two channel arms and either a first or second discharge channel part of the discharge channel, opens out on a connecting surface of the first or second housing part forming a gas outlet opening arranged apart from the separating plane.

15 Claims, 4 Drawing Sheets

(51) Int. Cl.

| | |
|---|---|
| ***F04D 17/10*** | (2006.01) |
| ***F04D 23/00*** | (2006.01) |
| ***F04D 29/40*** | (2006.01) |
| ***F04D 5/00*** | (2006.01) |
| *F04D 17/16* | (2006.01) |

(52) U.S. Cl.
CPC ..... *F04D 17/105* (2013.01); *F04D 23/008* (2013.01); *F04D 29/083* (2013.01); *F04D 29/403* (2013.01); *F04D 29/422* (2013.01); *F04D 17/168* (2013.01)

(56) References Cited

U.S. PATENT DOCUMENTS

| | | | | |
|---|---|---|---|---|
| 5,839,374 | A | 11/1998 | Conner et al. | |
| 9,297,276 | B2 * | 3/2016 | Herrmann | F01D 25/24 |
| 9,568,010 | B2 | 2/2017 | Adhvaryu et al. | |
| 9,677,561 | B2 | 6/2017 | Fischer | |
| 10,253,662 | B2 * | 4/2019 | Elsaesser | B01D 45/08 |
| 2013/0195606 | A1 * | 8/2013 | Adhvaryu | F04D 29/441 415/208.1 |
| 2014/0017064 | A1 * | 1/2014 | Fischer | F04D 29/4206 415/55.1 |
| 2014/0064948 | A1 | 3/2014 | Husted et al. | |
| 2018/0030868 | A1 | 2/2018 | Elsaesser et al. | |
| 2018/0202447 | A1 * | 7/2018 | Dittmar | F04D 5/007 |
| 2020/0291833 | A1 | 9/2020 | Schatz et al. | |
| 2021/0095677 | A1 | 4/2021 | Dittmar et al. | |

FOREIGN PATENT DOCUMENTS

| | | | |
|---|---|---|---|
| CN | 204299884 | U | 4/2015 |
| CN | 104884814 | A | 9/2015 |
| CN | 108026805 | A | 5/2018 |
| CN | 209856081 | U | 12/2019 |
| CN | 110863928 | A | 3/2020 |
| DE | 2806620 | A1 | 8/1979 |
| DE | 10113249 | A1 | 10/2002 |
| DE | 10334950 | A1 | 12/2004 |
| DE | 102010046870 | A1 | 3/2012 |
| DE | 102011004512 | A1 | 8/2012 |
| DE | 102012208965 | A1 | 8/2013 |
| DE | 102015213549 | A1 | 1/2017 |
| DE | 102016223955 | A1 | 6/2018 |
| DE | 102017221318 | A1 | 5/2019 |
| EP | 3045733 | A1 | 7/2016 |
| GB | 1594180 | A | 7/1981 |
| GB | 9213438 | | 8/1992 |
| GB | 2268228 | A | 1/1994 |
| JP | H06050268 | A | 2/1994 |
| JP | 2001235398 | A | 8/2001 |
| WO | 2017084694 | A1 | 5/2017 |

OTHER PUBLICATIONS

Office Action dated Feb. 27, 2023 issued in Chinese counterpad application No. 202110489152.2 and English-language translation thereof.

Search Report dated Feb. 25, 2023 issued in Chinese counterpad application No. 202110489152.2 and English-language translation thereof.

* cited by examiner

SIDE CHANNEL COMPRESSOR FOR COMPRESSING GAS

CROSS REFERENCE TO RELATED APPLICATIONS

This application claims priority to German patent application DE 10 2020 205 531.9, filed Apr. 30, 2020, the entire content of which is incorporated herein by reference.

TECHNICAL FIELD

The disclosure relates to a side channel compressor for compressing gas.

BACKGROUND

A generic side channel compressor is described for example in the document DE 10 2016 223 955 A1, wherein a side channel of this side channel compressor is formed by at least three separate housing parts, which each support or form a channel part of the side channel. On a housing part, a gas outlet opening and on another housing part a gas inlet opening is formed, through which gas can flow into the side channel and, compressed, flow out of the side channel. Disadvantageous in this side channel compressor is its relatively complex housing geometry which can merely be realised relatively cost-intensively although, following current trends, housing geometries that are less complex or at least more cost-effective to manufacture are desirable.

SUMMARY

It is therefore an object of the disclosure to provide an improved or at least another embodiment of a side channel compressor for compressing a gas.

In the present disclosure, this object is achieved by a side channel compressor as described herein.

A basic idea of the disclosure is to optimize the producibility of a side channel compressor in that the side channel is merely formed by two housing parts, wherein on the housing parts a gas inlet opening and on the one or other housing part a gas outlet opening is formed in each case. Practically, the gas outlet opening is arranged on the respective housing part so that it is situated completely apart of a separating plane arranged between the two housing parts as a result of which the gas outlet opening is free of a separating plane, i.e., quasi joint-free.

According to the disclosure, a side channel compressor that is suitable for compressing a gas, e.g., air of blow-by gas of an internal combustion engine is proposed, which comprises a housing that forms a side channel. Furthermore, at least one impeller drive is arranged within the housing, which comprises an impeller for driving gas. The impeller practically has multiple impeller blades. The impeller drive is arranged within the housing so that the impeller or the impeller blades engage in the side channel in order to interact with the gas there. Practically, the side channel compressor can comprise a drive control arranged in or on the housing for regulating and/or controlling the impeller drive. In order to make possible a compact design of the side channel compressor and a favorable flow guidance of the gas in the side channel, the side channel can be designed for redirecting the gas flowing through it by at least 270°. Here, deviating angles, in particular angles in the range +/−10° about 270° are obviously also conceivable in popular circles of experts. The mentioned housing, furthermore, comprises a feed channel that is fluidically connected to the side channel for feeding gas to the side channel and a discharge channel that is fluidically connected to the side channel for discharging gas out of the side channel or forms these. Here, the feed channel branches into two separate channel arms each extending along a channel arm center axis. In other words, the feed channel can be of a two-arm design. Practically, the two channel arms can be spaced apart from one another in the direction of a transverse axis interconnecting the two channel arm center axes. At any rate, the housing is subdivided along a separating plane into a first housing part and a second housing part, which at least during the operation of the side channel compressor, sealingly lie against one another.

According to an aspect of the disclosure, the discharge channel is separated along the separating plane at least in sections into a first discharge channel part arranged integrally on the first housing part and a second discharge channel part arranged integrally on the second housing part. Here, either the first discharge channel part, forming a gas outlet opening arranged completely apart from the separating plane for conducting gas can open out on a connecting surface of the first housing part, or the second discharge channel part, forming a gas outlet opening arranged completely apart from the separating plane for conducting gas, can open out on a connecting surface of the second housing part. By way of this, the solution according to the disclosure offers the effect that at least the gas outlet opening and if applicable the connecting surface and practically a housing part section arranged directly in the region of the connecting surface forming the gas outlet opening of the housing part forming the respective discharge channel part are not separated by the separating plane. Because of this, the gas outlet opening and the connecting surface are advantageously integral throughout and free of separating joints all round. This configuration offers the advantage that a sealing of the gas outlet opening with respect to further components to be connected, which is otherwise challenging because of the existing separating joints, can be relatively easily accomplished. At the same time, this design offers the advantage that the discharge channel as part of its manufacture can be in particular more easily demolded, for example during a casting manufacture.

Practically, the feed channel can also be separated along the separating plane at least in sections, namely in a first feed channel part arranged integrally on the first housing part and a second feed channel part arranged integrally on the second housing part. Here it is practical when the side channel is also separated along the separating plane to form a first and second side channel part, wherein these side channel parts are integrally formed on one and on the other housing part. Practically, two separate housing parts each equipped with channel parts of the side channel compressor are obtained, which—in the assembled state of the side channel compressor—sealingly lie on top of one another.

Further practically, the discharge channel or the first and second discharge channel part can be passed through between the two channel arms of the feed channel and the side channel be formed ring-like. For the improved redirection of gas, the latter can bring about a circle redirection of the gas flowing through by at least 180°, by at least 200°, by at least 220°, by at least 240° or by at least 270°. Because of this, the flowing gas can be redirected to a relatively major extent and the side channel compressor designed so as to be relatively compact.

Practically, the gas outlet opening can be framed by a completely surrounding sealing seat. Here, the sealing seat can comprise or form an all-round contiguous and joint-free sealing surface. The sealing surface can be formed by one of the connecting surfaces and/or by a channel inner surface of the first discharge channel part and/or by a channel inner surface of the second discharge channel part. This has the advantageous effect that the respective gas outlet opening is framed by a housing part section of the respective housing part that is designed in a joint-free or separating plane-free manner. Because of the joint-free or separating plane-free design, the sealing can be realized relatively easily. Here, the sealing surface can form an axial sealing surface for forming an axial seal between the components to be joined. Alternatively, the sealing surface can also form a radial sealing surface when the sealing surface is arranged on the channel inside.

Practically, a transverse axis is defined which stands perpendicularly on the channel arm center axes and/or connects these to one another. With respect to this transverse axis, the separating plane can be aligned transversely or at a right angle and/or with respect to the two channel arm center axes, parallel or substantially parallel in each case. In this connection, the channel arm center axes can be advantageously aligned substantially parallel or parallel to one another. This has the effect that the separating plane, with respect to the channel arms, is defined with regard to its position.

Further practically, the housing, in particular the first housing part and/or the second housing part, can form a tubular outlet connector extending along a connector center axis for letting gas out of the discharge channel or out of the side channel. The outlet connector can be rotation-symmetrical with respect to the connector center axis and hollow-cylindrical and, on the pipe front end, form an annular front face and the mentioned gas outlet opening. In the radial direction, the outlet connector is practically closed off by a connector outer surface. The outlet connector can be molded or attached for example on the housing, in particular on the first housing part and/or on the second housing part and practically project connector-like with regard to the housing, in particular the first housing part and/or the second housing part. It is at least conceivable that the connector center axis can stand perpendicularly on the housing, in particular the first housing part and/or the second housing part or perpendicularly on the transverse axis. If applicable, the connecting surface can be formed by the annular front face of the outlet connector.

In order to be able to arrange further components on the side channel compressor, the outlet connector can form either an axial sealing seat and/or a radial sealing seat. For this purpose, the front-end face of the outlet connector can form a contiguous, joint-free connecting surface completely surrounding the gas outlet opening, which in turn represents a sealing surface of an axial sealing seat. With the axial sealing seat, an axial sealing function can be advantageously realized. Additionally or alternatively, the outlet connector can comprise an axial sealing flange which forms a contiguous, joint-free sealing surface of an axial sealing seat completely surrounding the gas outlet opening. Practically, the axial sealing flange projects, with respect to the connector center axis, radially from the connector outer surface of the outlet connector. Additionally or alternatively, the outlet connector can form or comprise a channel inner surface of the first discharge channel part or of the second discharge channel part that is orientated radially to the inside. The channel inner surface orientated towards the inside is quasi the counter-surface to the connector outer surface. At any rate, this channel inner surface can form a contiguous, joint-free sealing surface of a radial sealing seat completely surrounding the gas outlet opening. With the radial sealing seat, a radial sealing function can be realized, for example when a further component is plugged into the outlet connector. Altogether this has the effect that on the outlet connector for example a supply hose or a supply connector forming an axial seal or a radial seal can be arranged. The contiguous, joint-free design of the sealing surfaces completely surrounding the gas outlet opening brings about in particular a relatively simple leakage-free sealing of the components.

Further practically, the outlet connector can be inclined at an angle with respect to the separating plane or with respect to the transverse axis or with respect to the housing or with respect to the first housing part and/or to the second housing part. In particular so that the front-end face of the outlet connector is completely situated next to the separating plane. Because of this, the front-end face or the connecting surface and/or the sealing surface and the gas outlet opening can be configured spaced apart from the separating plane and free of a separating plane. By way of the angular inclination, the outlet connector can, with the front-end face, quasi dip through below or above the separating plane. Practically, the outlet connector can be angularly inclined with respect to the separating plane and/or the transverse axis at an angle between 10° and 90°, in particular exactly 90°. Practically, between the connector center axis of the outlet connector and the separating plane and/or the transverse axis, an angle between 10° and 90°, in particular exactly 90° is defined. Furthermore it can be imagined that the connector center axis is aligned at a right angle with respect to one or both channel arm center axes.

Furthermore, the outlet connector can be of a constant cross-sectional area along the connector center axis or have a variable cross-sectional area along the connector center axis. In particular, the outlet connector can be bent hook-like.

Practically, the outlet connector is subdivided by the separating plane. Practically, this division provides a first connector part arranged on the first housing part and a second connector part arranged on the second housing part, wherein however the front-end face forming the connecting surface is configured separating plane-free and completely formed on the first or on the second connector part. By way of this, the outlet connector is separated, namely into a first connector part and into a second connector part, but the front-end face or the connecting surface is separating plane-free, i.e., joint-free. The connector parts per se can be integrally formed on the respective housing part. During the operation of the side channel compressor, the first and second connector part can sealingly lie on top of one another. This has the advantageous effect that the outlet connector can be inclined less angularly, as a result of which in particular the gas flow guidance is improved.

Further practically, a circumferential sealing tape or a circumferential sealing cord can be arranged, sandwich-like, between the first and second connector part and/or the first and second discharge channel part and/or the first and second feed channel part and/or between a first and second side channel part of the side channel, in order to mutually seal the housing parts. It is advantageous when the sealing tape or the sealing cord run parallel to or even within the separating plane. Furthermore, the sealing tape or the sealing cord can be formed continuously all round and without interruption. The sealing tape or the sealing cord provide a sealing function which realizes the sealing, in particular of the side channel and of the two connector parts with respect to the atmosphere surrounding the side channel compressor.

Practically, the sealing tape or the sealing cord can be touchingly supported on two planar circumferential sealing surfaces, wherein a first circumferential sealing surface is formed by the first housing part and wherein a second circumferential sealing surface is formed by the second housing part. A groove, which can receive and retain the sealing tape, or the sealing cord can be introduced for example in the one or other circumferential sealing surface. Practically, the first and second circumferential sealing surface can run parallel to or within the separating plane.

Furthermore, the one channel arm or the two channel arms can be integrally arranged on the first housing part and be connected to the first feed channel part of the feed channel, wherein the other channel arm of the two channel arms can be integrally arranged on the second housing part and connected to the second feed channel part of the feed channel.

It is practical, furthermore, to align the respective channel center axes of the two channel arms relative to one another at least in sections. By way of this, a simple demolding of the housing parts during the manufacture of the side channel compressor is favored.

Through practically, the one channel arm of the two channel arms can open out on the first housing part forming a first gas inlet opening on a first plug-in surface aligned transversely, in particular at a right angle with respect to the connecting surface. Furthermore, the other channel arm of the two channel arms can open out on the second housing part forming a further second gas inlet opening on a second plug-in surface aligned transversely, in particular at a right angle with respect to the connecting surface. Practically, a supply hose each or a supply connector each can be arranged on the two gas inlet openings in order to supply the side channel compressor.

Practically, the side channel compressor can comprise a separately formed one-piece Y-inlet connector, which comprises an inlet pipe for letting gas into the side channel, in particular for connecting a supply hose or a supply connector. The inlet pipe branches into two plug-in pipes, wherein the one plug-in pipe is plugged into the first gas inlet opening and the further plug-in pipe into the further second gas inlet opening. By way of this, the gas can quasi be sent into the side channel compressor. Here, the Y-inlet connector is axially and/or radially sealed in the direction of the side channel. Preferably, an O-ring each for forming a radial seal is arranged on the outer diameter of the respective plug-in pipe, as a result of which the radial seal is formed during the assembly. Preferably, both plug-in pipes are arranged parallel to one another, as a result of which a simple assembly through a simultaneous plugging-in of the plug-in pipes is made possible.

In summary it remains to be noted: the present disclosure preferentially relates to a side channel compressor for compressing gas having a housing that forms an annular side channel, which is designed for redirecting the gas flowing through the side channel by at least 270°, having an impeller drive arranged in the housing which comprises an impeller arranged in the side channel for driving gas through the side channel, wherein the housing forms a feed channel that is fluidically connected to the side channel for feeding gas to the side channel and a discharge channel that is fluidically connected to the side channel for discharging gas out of the side channel, wherein the feed channel branches into two separate channel arms each extending along a channel center axis, wherein the housing is subdivided along a separating plane into a first housing part and a second housing part which, sealed, lie against one another. It is substantial for the disclosure that the discharge channel is passed through between the two channel arms and that either a first or second discharge channel part of the discharge channel, forming a gas outlet opening arranged apart from the separating plane, opens out on a connecting surface of the first or second housing part.

Further important features and advantages of the disclosure are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present disclosure.

Preferred exemplary embodiments of the disclosure are shown in the drawings and are explained in more detail in the following description, wherein same reference numbers relate to same or similar or functionally same components.

BRIEF DESCRIPTION OF THE DRAWINGS

The disclosure will now be described with reference to the drawings wherein.

DESCRIPTION OF EXEMPLARY EMBODIMENTS

FIGS. 1 to 7 show two preferred exemplary embodiments of a side channel compressor altogether marked here and there with 1. These serve for compressing gas, for example air or blow-by gas of an internal combustion engine.

Figure 1:
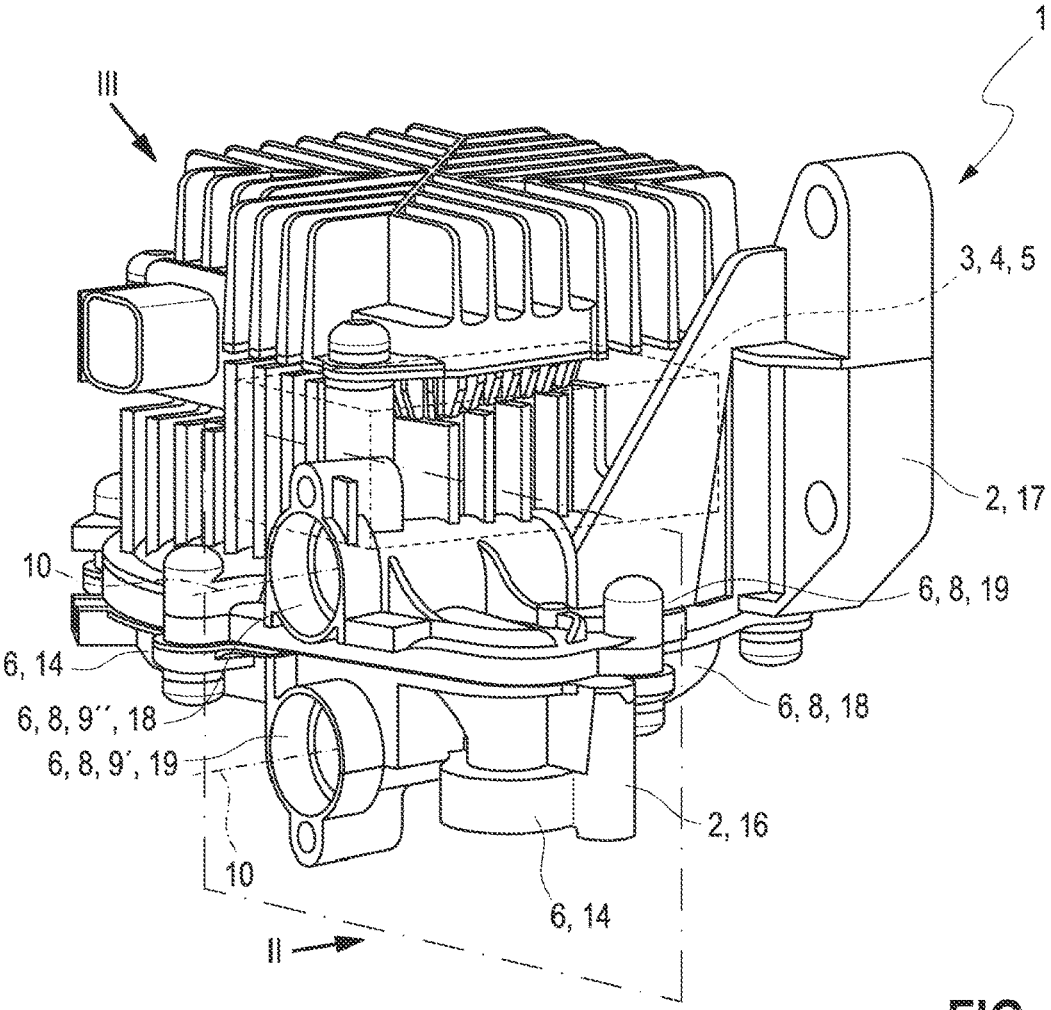
FIG. 1 shows a perspective view of a preferred exemplary embodiment of a side channel compressor according to the disclosure.

According to FIG. 1, a perspective view of a preferred exemplary embodiment of a side channel compressor 1 according to the disclosure is illustrated, which for compressing gas comprises a housing 2, in which exemplarily a side channel 6 that can be flowed through by gas and a completely internal installation chamber 3 are formed, wherein in the installation chamber 3 an impeller drive 4 for driving or for compressing gas is arranged. Practically, the impeller drive 4 is regulatable and/or controllable by means of a drive control arranged on the housing 2 which is not illustrated here and suppliable by means of not illustrated supply lines. The impeller drive 4 is arranged within the housing 2 or within the installation chamber 3 so that its impeller 5 or its impeller blades can engage in the side channel 6 and fluidically interact with the gas in order to bring about the desired compression of the gas. The installation chamber 3, the impeller drive 4 and the impeller 5 are indicated in FIG. 1 by a small dashed-line box in a highly simplified manner.

Figure 2:
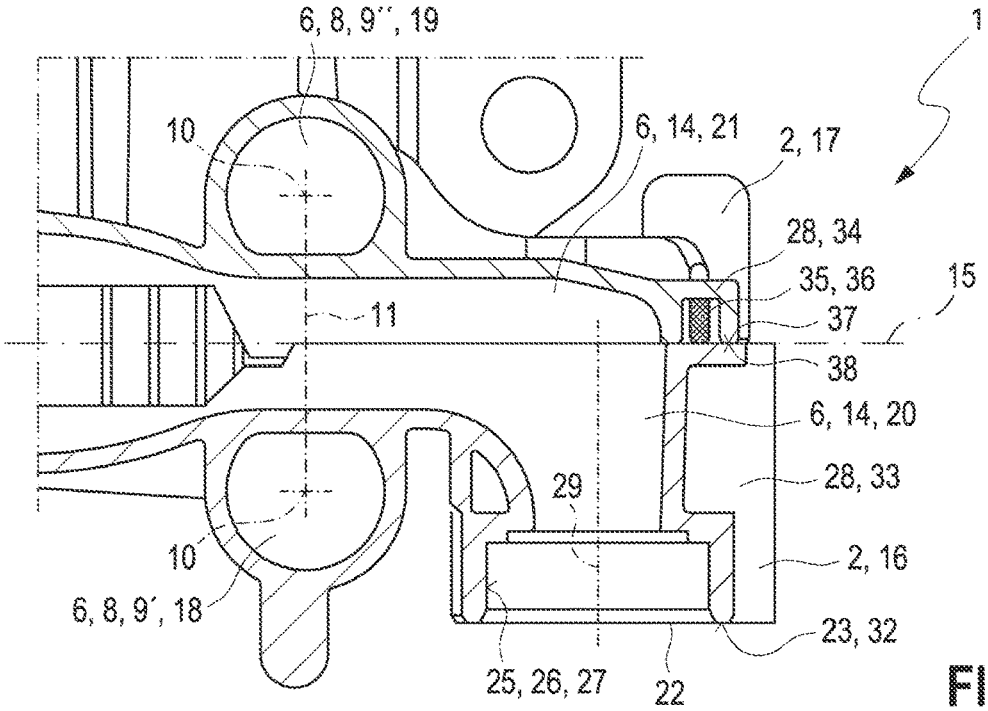
FIG. 2 shows a sectional view of the side channel compressor from FIG. 1 according to a section plane indicated by arrow II there.

FIG. 2 shows in a sectional view the side channel compressor 1 from FIG. 1 according to a section plane indicated with arrow II there, wherein it is noticeable that the side channel 6, because of its circular or annular configuration is designed for redirecting the gas flowing through it by at least 270°. A feed channel 8 is connected to the side channel 6. The feed channel 8 serves for feeding gas towards the side channel 6, both channels are thus fluidically connected to one another. Furthermore, the feed channel 8 branches into two separate channel arms 9', 9" which exemplarily extend each parallel to one another, see also FIG. 1, wherein the two channel arms 9', 9" are spaced apart from one another in the direction of a transverse axis 11 connecting the two channel arm center axes 10 to one another. According to FIG. 2 it is noticeable, furthermore, that the side channel 6 is also connected to a discharge channel 14. The discharge channel 14 serves for discharging the compressed gas out of the side channel 6. The discharge channel 14 is also fluidically connected to the side channel 6.

In order to achieve redirection of the gas by at least 270° with the side channel 6 and in order to achieve a relatively compact embodiment of the side channel compressor 1, for example in order to arrange the same in a space-saving manner in a motor vehicle, it is exemplarily provided, as is noticeable in FIGS. 1 and 2, that the discharge channel 14 is passed through between the two channel arms 9', 9". In a manner of speaking like the thread through the eye of a needle. Thus, the fluid flows intersect in different planes.

In order to be able to produce the side channel compressor 1 relatively cost-effectively it is further exemplarily provided, see in particular FIG. 2, to define a planar separating plane 15, which is practically aligned transversely relative to the transverse axis 11 and parallel with respect to the two channel arm center axes 10. Here, the separating plane 15 is passed through between the two channel arms 9', 9" so that it exemplarily penetrates the transverse axis 11 equally. The housing 2 is now separated along the separating plane 15 into a first lower housing part 16 and a second upper housing part 17. The side channel 6, the feed channel 8 and the discharge channel 14 are separated along the separating plane 15, namely the side channel 6 into a first side channel part and a second side channel part, the feed channel 8 into a first feed channel part 18 arranged integrally on the first housing part 16 and a second feed channel part 19 arranged integrally on the second housing part 17 and the discharge channel 14 into a first discharge channel part 20 arranged integrally on the first housing part 16 and a second discharge channel 21 arranged integrally on the second housing part 17. In the assembled state of the side channel compressor 1, i.e., when the two housing parts 16, 17 touching lie on top of one another, all these channel parts are together in order to form the side channel 6, the feed channel 8 and the discharge channel 14.

In order to discharge compressed gas out of the housing 2 or out of the side channel 6 it is exemplarily provided that the first discharge channel part 20, forming a gas outlet opening 22 arranged completely apart from the separating plane 15, opens out on a planar connecting surface 23 of the first lower housing part 16. Because it is located apart from the separating plane 15, the gas outlet opening 22 is not intersected by the separating plane 15, i.e., is separating joint-free. Because of this, for example a supply hose can be connected relatively easily and practically without leakage. It is conceivable, furthermore, but not shown, that alternatively the second discharge channel part 21, forming a gas outlet opening 22 that is arranged completely apart from the separating plane 15, opens out on a connecting surface 23 of the second housing part 17 for conducting gas out of the side channel 6.

According to FIG. 2, a common hollow-cylindrical outlet connector 28 for letting gas out of the side channel 6 or out of the discharge channel 14 is formed on the first housing part 16 and on the second housing part 17. The outlet connector 28 protrudes over the housing parts 16, 17, extends along a connector center axis 29 and, on the pipe front end, has an annular front face, which exemplarily forms the connecting surface 23 limiting the gas outlet opening 22. Because of this, the outlet connector 28 is, by force, longitudinally penetrated by the first and second discharge channel part 20, 21. This has the effect that the connecting surface 23 is not necessarily arranged directly on the housing 2 or on the respective housing part 16, 17. Furthermore, the outlet connector 28 is inclined at a right angle with respect to the separating plane 15. Since the outlet connector 28 is arranged both on the first housing part 16 and also on the second housing part 17, it quasi intersects with the separating plane 15, so that it is separated below the separating plane 15 into a first connector part 33 arranged integrally on the first housing part 16 and above the separating plane 15 into a second connector part 34 arranged integrally on the second housing part 17. Thus, the outlet connector 28 quasi comprises a first and a second discharge channel part 20, 21. Furthermore it is noticeable in FIG. 2 that the connecting surface 23 framing the gas outlet opening 22 is arranged apart from the separating plane 15 and thus joint-free.

Exemplarily, the connecting surface 23 forms a completely circumferential sealing seat 25, which has a sealing surface 26 that is contiguous all round and joint-free. The sealing seat 25 or the sealing surface 26 are likewise arranged completely apart from the separating plane 15 so that they are not intersected, i.e., quasi joint-free.

To make it possible that components such as supply hoses or supply connectors can be connected to the outlet connector 28 in a radially sealed manner, it is provided according to the first exemplary embodiment that the sealing seat 25 or the sealing surface 26 forms a radial sealing seat 32, wherein a channel inner surface 27 of the first discharge channel part 20 that is orientated with respect to the connector center axis 29 radially to the inside forms the sealing surface 26. The channel inner surface 27, i.e., the sealing surface 26, is contiguous, joint-free and frames the gas outlet opening 22 all-round the connector center axis 29 completely.

Figure 3:
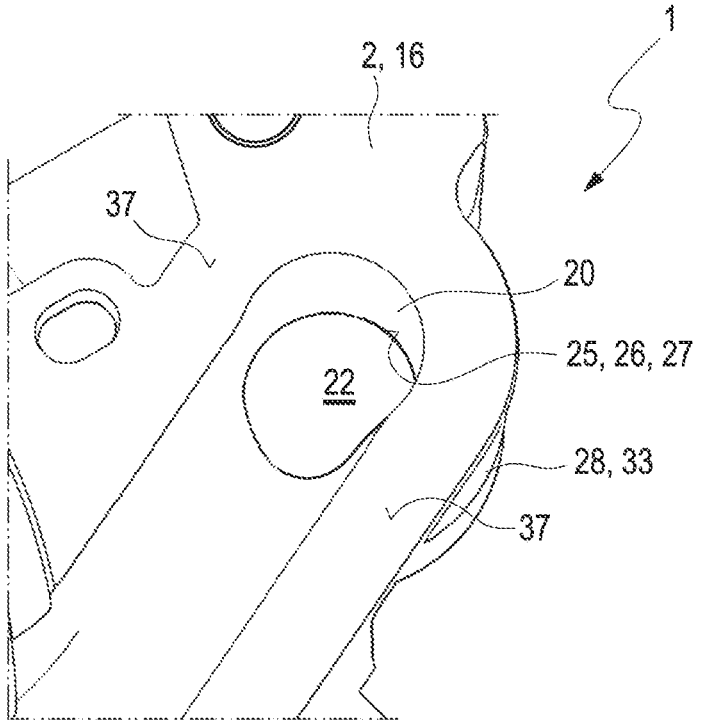
FIG. 3 shows a perspective view obliquely from above of a housing part of the housing of the side channel compressor from FIG. 1 with view according to an arrow III entered there.

FIG. 3 shows a perspective view obliquely from above of the first lower housing part 16 of the housing 2 of the side channel compressor 1 from FIG. 2 with view according to an arrow III entered there. The first connector part 33 of the outlet connector 28 with gas outlet opening 22 and the channel inner surface 27 of the first discharge channel part 20 forming the sealing seat 25 or the sealing surface 26 are clearly noticeable.

In FIGS. 2 and 3, two circumferential sealing surfaces 37, 38 are shown, furthermore, which are arranged exemplarily in a flanking manner along the first and second side channel part, the first and second connector part 33, 34, the first and second discharge channel part 20, 21 and the first and second feed channel part 18, 19. Here, the first circumferential sealing surface 37 is integrally formed by the first housing part 16, the second circumferential sealing surface 38 is integrally formed by the second housing part 17, see in particular FIG. 2. Exemplarily, the circumferential sealing surfaces 37, 38 are arranged parallel to or within the separating plane 15. In the assembled state of the side channel compressor 1, a circumferential and continuous sealing tape 35 or a circumferential and continuous sealing cord 36 are arranged sandwich-like between the two circumferential sealing surfaces 37, 38 in order to seal the side channel 6, see FIG. 2.

Figure 4:
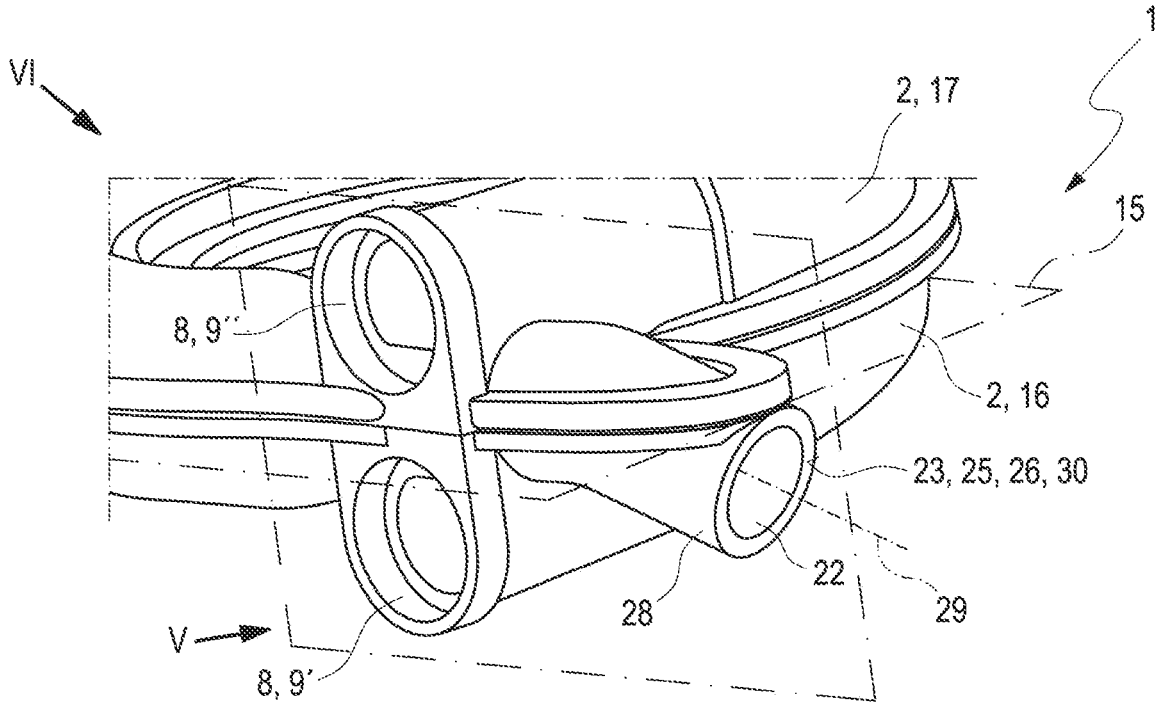
FIG. 4 shows a perspective view of a preferred further exemplary embodiment of a side channel compressor according to the disclosure.
Figure 5:
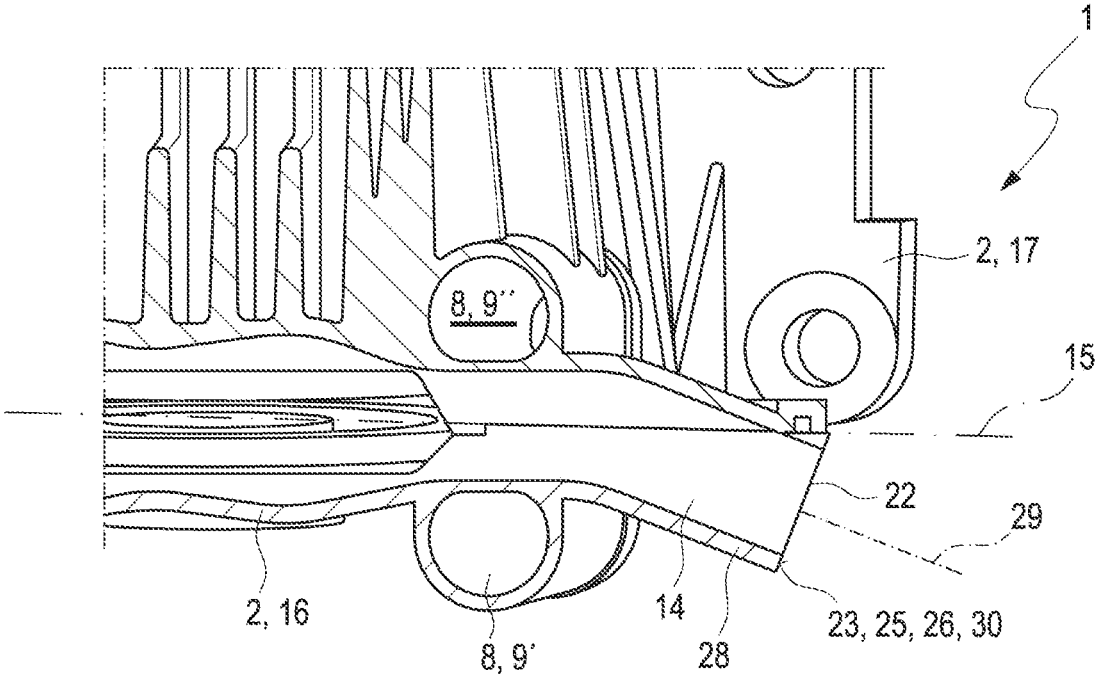
FIG. 5 shows a sectional view of the side channel compressor from FIG. 4 according to a section plane indicated with arrow V there.

In FIGS. 4 and 5, a preferred further exemplary embodiment of a side channel compressor 1 according to the disclosure is shown. In contrast with the exemplary embodiment described above it is provided here that the outlet connector 28 formed on the first and second housing part 16, 17 of the housing 2 is merely inclined at an angle with respect to the separating plane 15, i.e., not at a right angle. For example, the outlet connector 28 or its connector center axis 29 is inclined by 30° with respect to the separating plane 15. By way of this, the outlet connector 28 can also quasi dip through under the separating plane 15 in order to arrange the connecting surface 23 or the sealing surface 28 apart from the separating plane 14 in order to achieve a design free of a separating plane.

Figure 6:
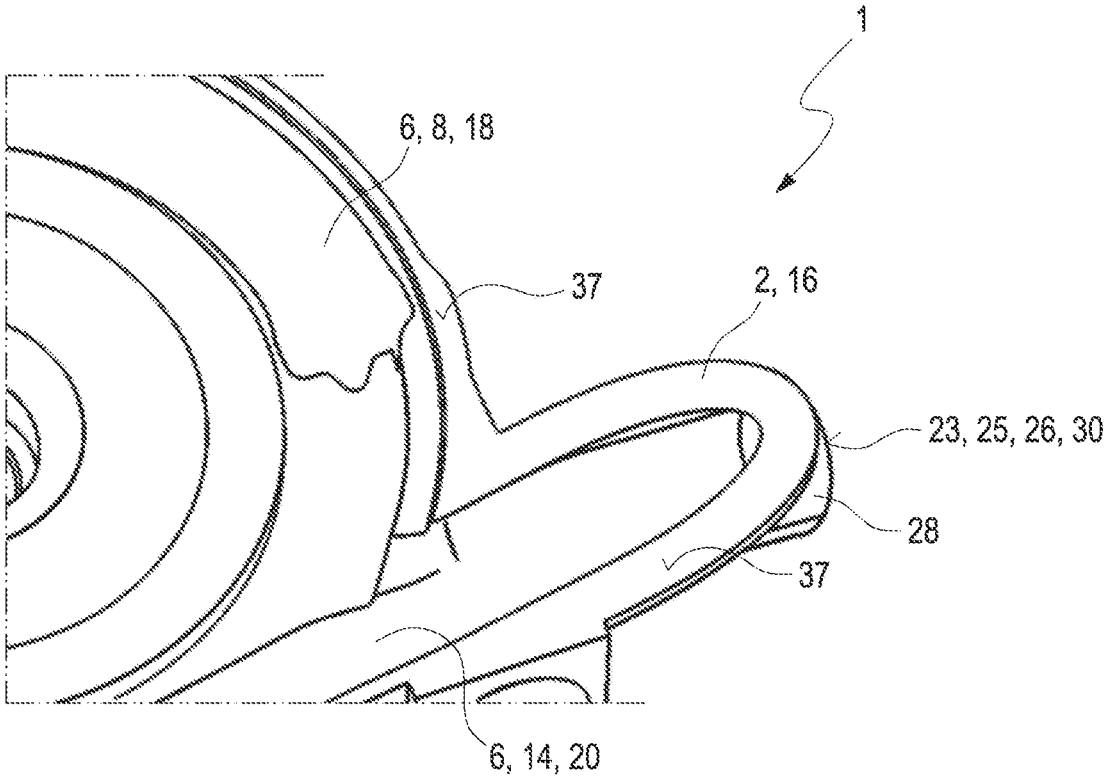
FIG. 6 shows a perspective view obliquely from above of a housing part of the housing of the side channel compressor from FIG. 4 with view according to an arrow VI entered there.

FIG. 6 shows a perspective view obliquely from above of the first housing part 16 of the housing 2 of the side channel compressor 1 from FIG. 4 with view according to an arrow VI entered there, so that the outlet connector 28 is noticeable from the inside and the circumferential sealing surfaces 27 provided there. In FIG. 6, it is possible to quasi look into the side channel 6, namely once into the first feed channel part 18 of the feed channel 8 arranged integrally on the first housing part 16 and the first discharge channel part 20 of the discharge channel 14.

In order to make it possible that components to be connected to the outlet connector 28, such as supply hoses or supply connectors cannot only be connected subject to radial sealing but also subject to axial sealing, a sealing seat 25 arranged on the outlet connector 28 forms an axial sealing seat 30 according to FIGS. 4 to 6. According to this exemplary embodiment, it is provided that the front-end connecting surface 23 of the outlet connector 28 forms a contiguous axial sealing surface 26 of the sealing seat 25 that is joint-free and completely surrounds the gas outlet opening 22.

Figure 7:
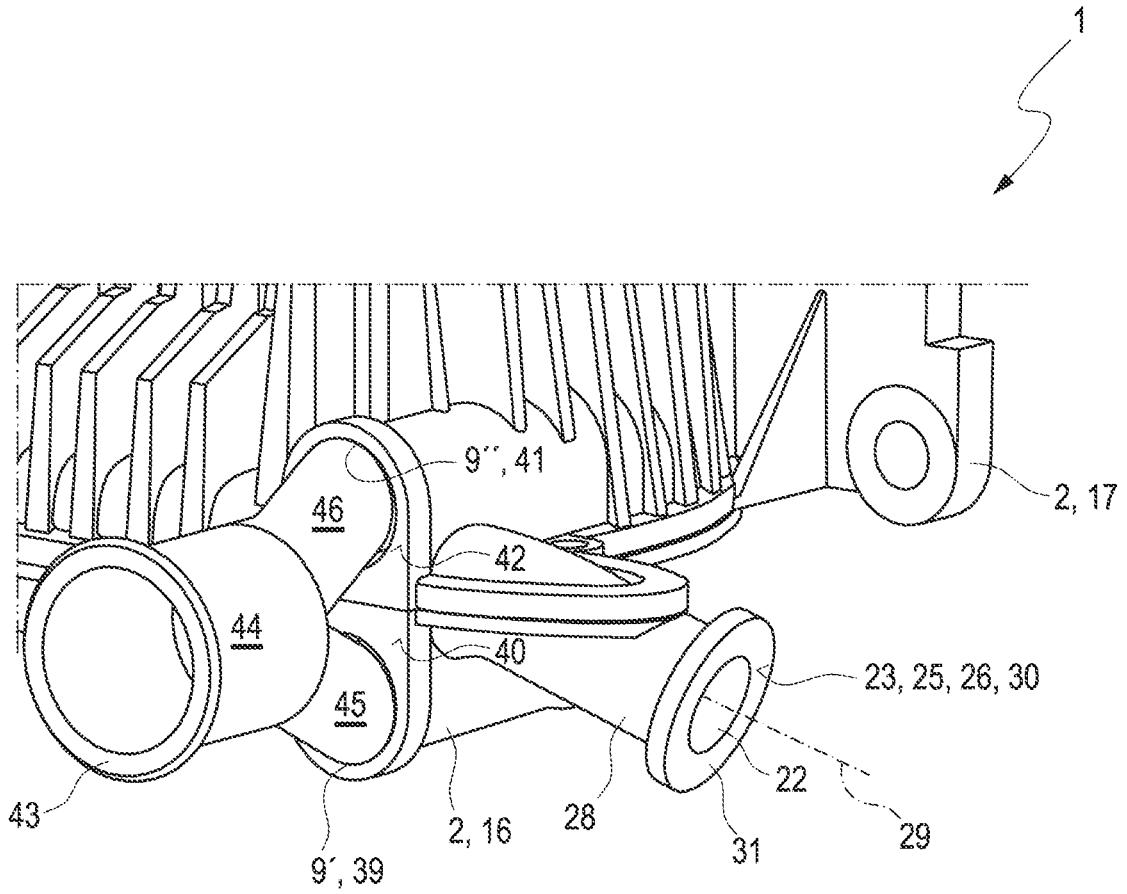
FIG. 7 shows a perspective view of the side channel compressor from FIG. 4 as in FIG. 4, wherein on the housing of the side channel compressor a Y-inlet connector is arranged.

Finally, FIG. 7 shows a perspective view of the side channel compressor 1 from FIG. 4 as in FIG. 4, wherein on the housing 2 of the side channel compressor 1 a Y-inlet connector 43 is arranged. Furthermore, the axial sealing seat 30 is slightly modified. The axial sealing seat 30 according to FIG. 7, in contrast with FIGS. 4 to 6, comprises an axial sealing flange 31 arranged on the outlet connector 28. The axial sealing flange 31 defines a contiguous sealing seat 25 with sealing surface 26 that is joint-free and completely surrounds the gas outlet opening 22, which is also referred to as axial sealing seat 30. The axial sealing flange 31 projects, with respect to the connector center axis 29, radially away from the outlet connector 28. With respect to the Y-inlet connector 43 it is noticeable in FIG. 7 that the one channel arm 9' of the two channel arms 9', 9", forming a first gas inlet opening 39 on a first plug-in surface 40 orientated transversely with respect to the connecting surface 23, opens out on the first housing part 16 and that the other channel arm 9" of the two channel arms 9', 9", forming a further second gas inlet opening 41 on a second plug-in surface 42 orientated transversely with respect to the connecting surface 23 and parallel with respect to the first plug-in surface 40, opens out on the second housing part 17. The Y-inlet connector 43 in turn comprises an inlet pipe 44 for letting-in gas for the side channel 6 which branches into two plug-in pipes 45, 46. The one plug-in pipe 45 is plugged into the first gas inlet opening 39 and the further plug-in pipe 46 into the further second gas inlet opening 41.

It is understood that the foregoing description is that of the exemplary embodiments of the disclosure and that various changes and modifications may be made thereto without departing from the spirit and scope of the disclosure as defined in the appended claims.

What is claimed is:

1. A side channel compressor for compressing gas, the side channel compressor comprising:

a housing, which forms a side channel; and an impeller drive arranged in the housing, which comprises an impeller arranged in the side channel for driving gas through the side channel, wherein the housing forms a feed channel, that is fluidically connected to the side channel, for feeding gas to the side channel and a discharge channel, that is fluidically connected to the side channel, for discharging gas out of the side channel, wherein the feed channel branches into two separate channel arms each extending along a channel arm center axis, wherein the housing is subdivided along a separating plane into a first housing part and a second housing part, which, sealed, lie against one another, wherein the discharge channel is separated at least in sections along the separating plane into a first discharge channel part arranged integrally on the first housing part and a second discharge channel part arranged integrally on the second housing part, wherein the discharge channel or the first and second discharge channel parts are passed through between the two channel arms of the feed channel, wherein either the first discharge channel part, forming a gas outlet opening arranged completely apart from the separating plane, opens out on a connecting surface of the first housing part for conducting gas, or the second discharge channel part, forming the gas outlet opening arranged completely apart from the separating plane, opens out on a connecting surface of the second housing part for conducting gas, and wherein the connecting surface is arranged at a distance from the impeller in a radial direction.

2. The side channel compressor according to claim 1, wherein the feed channel is separated at least in sections along the separating plane into a first feed channel part arranged integrally on the first housing part and a second feed channel part arranged integrally on the second housing part.

3. The side channel compressor according to claim 1, wherein the side channel is configured annularly and is configured to redirect the gas flowing through the side channel by at least 180°, by at least 200°, by at least 220°, by at least 240° or by at least 270°.

4. The side channel compressor according to claim 1, wherein the gas outlet opening is framed by a completely surrounding sealing seat which has an all-round contiguous and joint-free sealing surface.

5. The side channel compressor according to claim 4, wherein:

the sealing surface is formed by the connecting surface, and/or the sealing surface is formed by a channel inner surface of the first discharge channel part or by a channel inner surface of the second discharge channel part.

6. The side channel compressor according to claim 1, wherein a transverse axis is defined which stands perpendicularly on the channel arm center axes, and wherein the separating plane is arranged transversely or at a right angle with respect to the transverse axis and/or parallel or substantially parallel with respect to each of the two channel arm center axes.

7. The side channel compressor according to claim 1, wherein the housing or the first housing part and the second housing part forms a tubular outlet connector extending along a connector center axis for letting gas out of the side channel, which on a pipe front end comprises the connecting surface, on which the gas outlet opening opens out.

8. The side channel compressor according to claim 7, wherein:

the pipe front end connecting surface of the outlet connector forms a contiguous sealing surface of an axial sealing seat for an axial seal that is joint-free and completely surrounds the gas outlet opening, and/or the outlet connector furthermore comprises a circumferential axial sealing flange projecting radially from the outlet connector with respect to the connector center axis, which forms a contiguous sealing surface of an axial sealing seat for an axial seal that is joint-free and completely surrounds the gas outlet opening.

9. The side channel compressor according to claim 7, wherein the outlet connector comprises a channel inner surface of the first or second discharge channel parts that is orientated radially to an inside with respect to the connector center axis, and wherein this channel inner surface forms a contiguous sealing surface of a radial sealing seat for a radial seal that is joint-free and completely surrounds the gas outlet opening.

10. The side channel compressor according to claim 7, wherein:

the outlet connector is inclined at an angle with respect to the separating plane, so that a sealing surface and gas outlet opening of the outlet connector are configured spaced apart from the separating plane and free of a separating plane, and/or the outlet connector is subdivided by the separating plane into a first connector part arranged in particular integrally on the first housing part and into a second connector part arranged in particular integrally on the second housing part, wherein the connecting surface is configured free of a separating plane and formed completely on the first or on the second connector part.

11. The side channel compressor according to claim 10, wherein between the first and second connector parts and the first and second discharge channel parts and/or the first and second feed channel parts a surrounding sealing tape, in particular a surrounding sealing cord, is arranged sandwich-like, and wherein the sealing tape, in particular the sealing cord, runs parallel to the separating plane or within the separating plane.

12. The side channel compressor according to claim 11, wherein the sealing tape, in particular the sealing cord, are touchingly supported on two planar circumferential sealing surfaces on both sides, wherein a first circumferential sealing surface is formed by the first housing part and wherein a second circumferential sealing surface is formed by the second housing part.

13. The side channel compressor according to claim 1, wherein one channel arm is arranged integrally on the first housing part and fluidically connected to the side channel, and wherein an other channel arm is arranged integrally on the second housing part and fluidically connected to the side channel.

14. The side channel compressor according to claim 1, wherein one channel arm of the two channel arms, forming a first gas inlet opening, opens out on a first plug-in surface on the first housing part aligned transversely with respect to the connecting surface, and wherein an other channel arm of the two channel arms, forming a further second gas inlet opening, opens out on a second plug-in surface on the second housing part that is aligned transversely with respect to the connecting surface.

15. The side channel compressor according to claim 14, wherein the side channel compressor comprises a separately formed one-piece Y-inlet connector, which comprises an inlet pipe for letting gas into the feed channel, which branches into two plug-in pipes, and wherein one plug-in pipe is plugged into the first gas inlet opening and a further plug-in pipe into the further second gas inlet opening.

* * * * *